United States Patent [19]

Dunchock

[11] 4,085,844

[45] Apr. 25, 1978

[54] STORAGE CONTAINER

[76] Inventor: Richard S. Dunchock, 27545 Gateway Dr., Farmington Hills, Mich. 48024

[21] Appl. No.: 794,054

[22] Filed: May 5, 1977

[51] Int. Cl.[2] ..... B65D 85/68

[52] U.S. Cl. ..... 206/335; D12/156

[58] Field of Search ..... 206/335, 319, 525, 527, 206/320, 326; 296/102; 217/37, 38, 36; 12D/156; 9D/259; 220/343, 334

[56] References Cited

U.S. PATENT DOCUMENTS

| | | | |
|---|---|---|---|
| 1,441,264 | 1/1928 | Bruewer | 217/36 |
| 2,511,460 | 6/1950 | Cancelli et al. | 296/102 |
| 2,817,436 | 12/1957 | Simpson | 206/319 |
| 3,949,528 | 4/1976 | Hartger et al. | 217/37 |

*Primary Examiner*—William T. Dixson, Jr.

*Attorney, Agent, or Firm*—Basile and Weintraub

[57] ABSTRACT

A container for storing an automobile top of the type which is adapted to be removably mounted to an automobile body. The storage container has a main body including an upright wall that is contoured to receive and support the roof and rear window portion of the automobile top and includes lower side walls that are similarly contoured to receive and support the side window portions of the car top. A cover having a Z-shaped configuration is adapted to be received by the body to enclose the automobile top within the storage container. Means are provided for releasably fastening the cover to the body to secure the automobile top therewithin. Bearing wheels disposed in the bottom of the storage container permit the same to be easily moved. In the preferred embodiment the body and cover of the storage container are each of a one-piece, integral, plastic construction.

6 Claims, 8 Drawing Figures

Fig. - 1
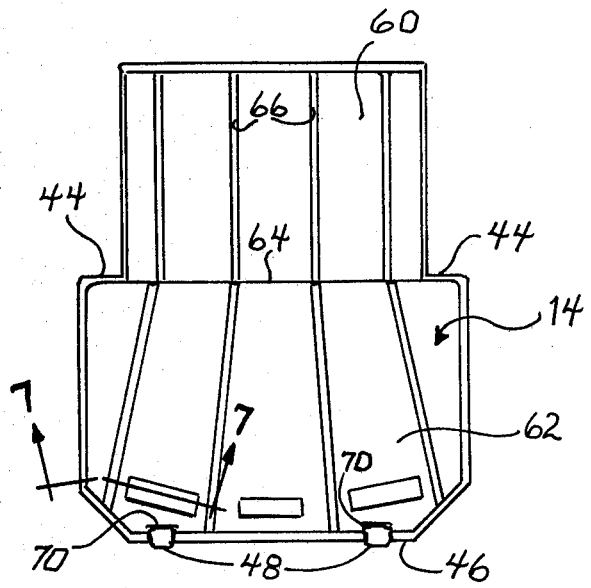
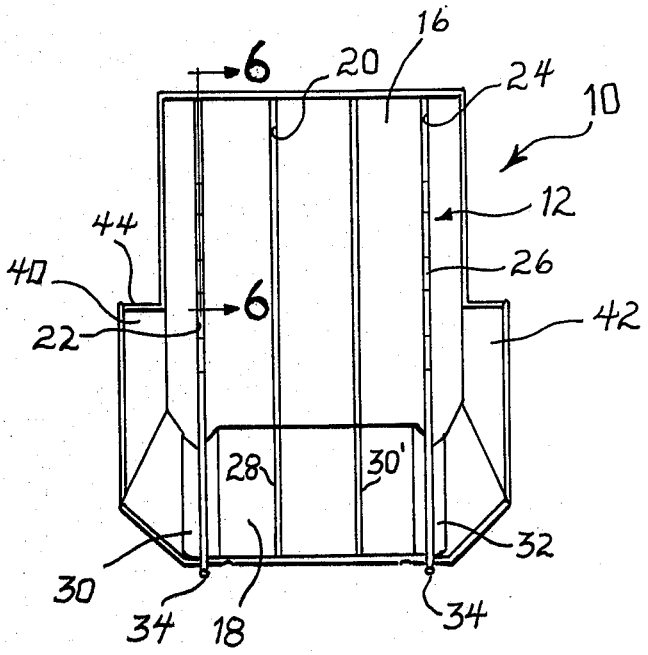
Fig.-2

STORAGE CONTAINER

BACKGROUND OF THE INVENTION

I. Field of the Invention

The present invention relates broadly to containers for storing and protecting items which may be easily damaged; and, in particular, the present invention relates to a container for storing a removable automobile top.

II. Description of the Prior Art

Automobiles have been manufactured which include a removable, hard top that is adapted to be releasably secured to the automobile body and removed from the automobile body to provide the user of the automobile with a convertible. One known automobile of the type described is manufactured and marketed under the trademark MERCEDES BENZ 450SL. This automobile has a hardtop which includes side windows and a rear window and is releasably attached to the automobile body. The top may be simply removed from the automobile body by two persons. Owners of such vehicles normally place the top in an upright position and generally in the corner of a garage, as there is no known simple and inexpensive means for safely storing such tops. These tops are very expensive and therefore must be handled in a delicate manner so as to ensure that the windows, exterior painted surfaces and interior matted surfaces are not damaged during the period in which the car tops are in a stored position. It can be easily visualized how such an automobile top could be inadvertently damaged as a result of many of the normal occurrences which take place in garages if the automobile top is not placed in a secured, protective container. To the knowledge of the inventor, the only containers that are available are those which are fabricated from wood and are in the form of a rectangular shape without a mating contour. These wooden crates are extremely heavy and may not be easily manipulated by the individual automobile owners.

It would therefore be desirable to provide a lightweight, protective container for storing automobile tops of the type described.

III. Prior Art Statement

The aforementioned description of the prior art includes, in the opinion of applicant, the closest prior art of which the applicant is aware.

SUMMARY OF THE INVENTION

The present invention, which will be described subsequently hereinafter, comprises a container for storing an automobile top of the type which is adapted to be releasably attached to automobile bodies. The container has a body portion, including an upright wall, contoured to receive and support the roof of the automobile top. The body includes a lower inclined wall integral with the upper wall and contoured to receive and support the rear window portion of the automobile top. The body further includes laterally extending side walls which are integral with the upright and inclined walls of the container body. The side walls are contoured to receive and support the sides of the automobile top. A cover having a Z-shaped configuration is received by the body. The cover is contoured to provide support for the automobile top and to retain the same in the body. The cover is releasably attached to the body.

It is a primary object of the present invention to provide a new and improved container for storing automobile tops.

It is a further object of the present invention to provide a storage container of the type described which is of a simple, integral, light-weight design that is relatively inexpensive to manufacture and maintain and one which is relatively simple for the users to manipulate in the placing of an automobile top therewithin and for the movement of the storage container after the same has been loaded with the automobile top.

Other objects, advantages and applications of the present invention will become apparent to those skilled in the art of storage containers when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a front elevational view of an automobile top storage container constructed in accordance with the principles of the present invention and illustrated in an upright position;

FIG. 2 is a rear elevational view of the storage container illustrated in FIG. 1;

DESCRIPTION OF THE PREFERRED EMBODIMENT

Figure 3:
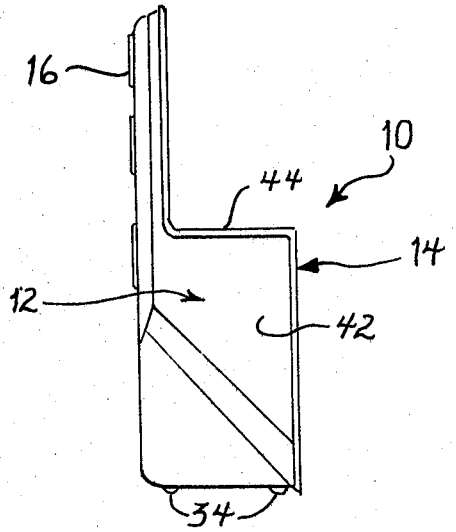
FIG. 3 is a left-side elevational view of the storage container illustrated in FIGS. 1 and 2 of the drawings, the left-side elevational view being substantially identical to the right-side elevational view, which is not shown.
Figure 4:
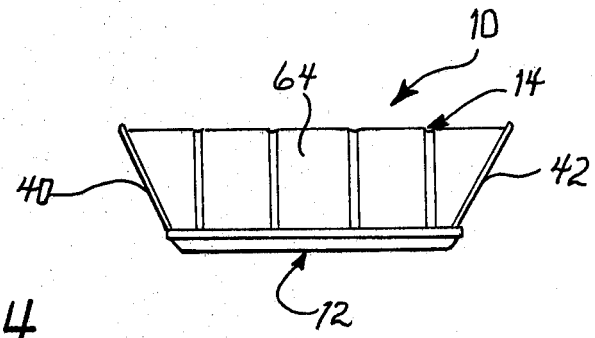
FIG. 4 is a top elevational view of the storage container illustrated in FIGS. 1 through 3 of the drawings.

Referring now to the drawings and, in particular, to FIGS. 1 and 2 wherein there is illustrated one example of the present invention in the form of a storage container 10. The storage container 10 comprises a body 12 that is enclosed by a cover 14. As can best be seen in FIG. 3, the body 12 has a Z-shaped configuration including an upright wall 16 which is integral with a lower inclined wall 18 which terminates at the bottom edge of the body 12. As can be particularly seen in FIGS. 2, and 8, the upright wall 16 is provided with a plurality of longitudinally disposed and laterally spaced raised sections or grooves 20, the two outermost grooves 22 and 24 being provided with a series of longitudinally spaced, inward projections 26. These projections 26 are designed to mate with correspondingly spaced chrome sections disposed on the top of the automobile roof of the type described in the prior art description and function to provide support for the roof without the body having to come into direct contact with the automobile top's painted surface. Similarly, the inclined wall 18 has a pair of raised sections or grooves 28 and 30' which are adapted to engage and support the outside surface of the rear window of the automobile top primarily to maintain the window at a spaced relationship with the remainder of the inclined wall 18 to further ensure that the rear window is not damaged. The raised sections 20, 28 and 30' provide additional structure and rigidity to the body to ensure that the automobile top is secure.

Figure 5:
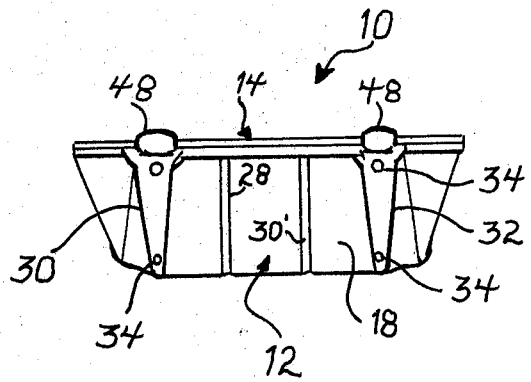
FIG. 5 is a bottom elevational view of the storage container illustrated in FIGS. 1 through 4 of the drawings.
Figure 6:
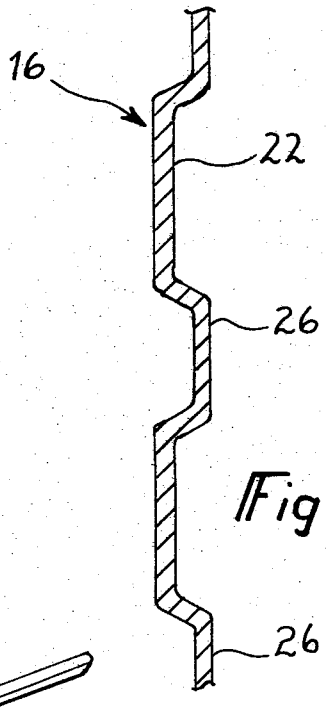
FIG. 6 is a fragmentary, longitudinal, cross-sectional view of the storage container taken along Line 6—6 of FIG. 2.

As can best be seen in FIGS. 2 and 5, the inclined wall 18 has a pair of integrally formed legs 30 and 32 which project downwardly from the inclined wall 18 to the bottom of the body 12. Each of the legs 30 and 32 mounts ball bearing type wheels 34 and is disposed with respect to each other in such a manner that when the container 10 is stored in an upright position, as illustrated in FIG. 2, the container is stored in the bearing wheels 34 in a stable manner. In this position the container 10 may be simply minipulated by the user and pushed to a desired location. The bearing wheels 34 are attached to the legs 30 and 32 by any suitable means, such as screws (not shown), that extend through the retainer base of the bearings 34 and into engagement with suitable fasteners on the inside of the bearing legs 30 and 32.

The body 12 further comprises a pair of laterally extending side walls 40 and 42 which commence at approximately the midsection of the body then extend outwardly therefrom. The side walls 40 and 42 are integral with the inclined wall 18 and the upright wall 16. The interior of the side walls 40 and 42 is so contoured so as to receive and provide lateral support for the side windows and side portions of the automobile top. It should be noted that the upper edge 44 of the side walls 40 and 42 is substantially perpendicular to the upright wall 16, for a reason which will become more apparent hereinafter.

For other reasons which will also become apparent hereinafter, the bottom edge 46 of the inclined wall 18 is provided with a pair of elongated tabs 48. The tabs 48 are immediately adjacent to the legs 30 and 32. The entire peripheral edge of the body 12 includes a flange 50 (FIG. 7) and an internal groove 52, which function to receive in an interlocking manner a complementarily shaped flange 54 formed on the outer perimeter of the cover 14.

Figure 7:
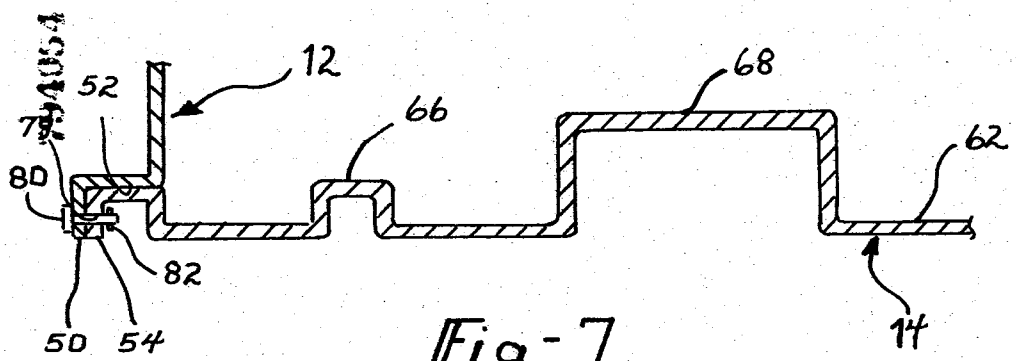
FIG. 7 is a fragmentary, longitudinal, cross-sectional view of the storage container as taken along Line 7—7 of FIG. 1.
Figure 8:
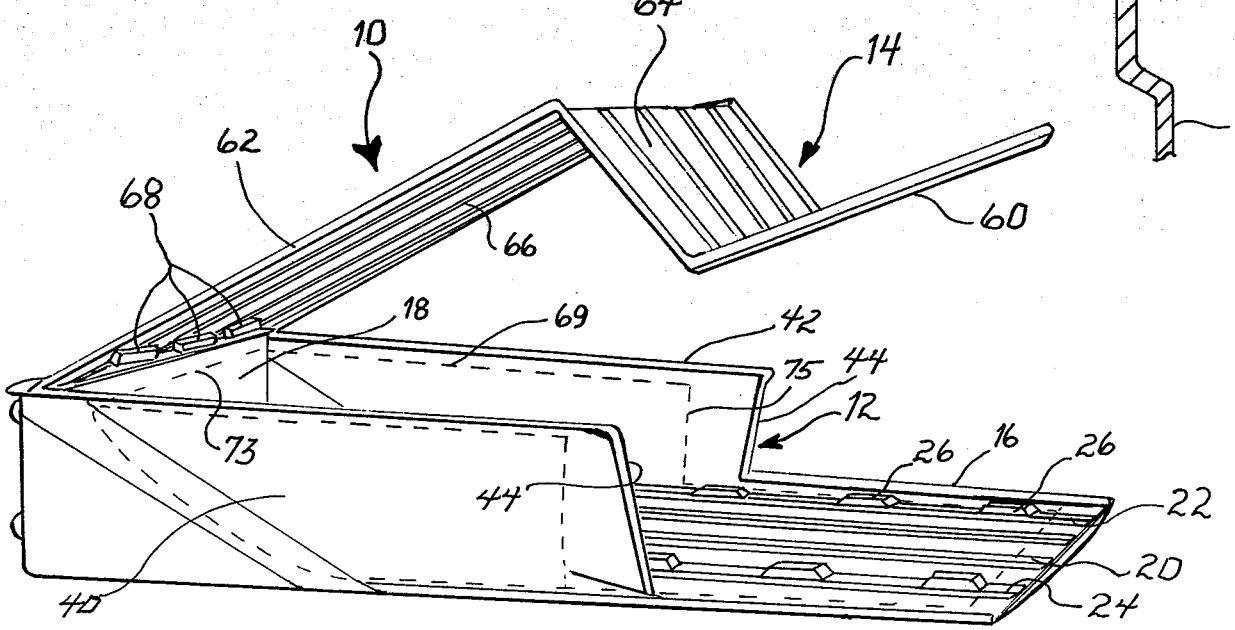
FIG. 8 is a perspective view of the container with the cover partially removed from the storage container with an automobile top shown in phantom lines.

As can best be seen in FIGS. 1, 3 and 8, the cover 14 has a Z-shaped configuration that is complementary to the Z-shaped configuration of the body 12. The cover 14 has an upper wall section 60 and a lower wall section 62 which are interconnected by a wall 64. As can be seen in FIG. 7, the outer edge of the cover 14 includes the aforementioned flange 54 which is sized and shaped such that the cover is complementarily received in the internal grooves 52 of the outer flange 50 such that the interior of the body is completely enclosed when the cover 14 is positioned thereon. The cover 14 includes a plurality of longitudinally disposed ribs 66 which provide rigidity to the cover and add to its structural integrity. The lower portion of the lower wall 62 includes a plurality of laterally spaced, inwardly projecting ribs 68 which are sized to engage the outside surface of the rear window portion of the automobile top 69 so as to prevent the top from moving within the container once the container cover 14 has been positioned on the body 12. The lower edge of the cover 14 has a pair of slots 70 which are alignable with the body tabs 48, as shown in FIG. 1.

In use, the body 12 is positioned with its outside surface being disposed on the ground, and the automobile top 69 (FIG. 8) is positioned upside down into the interior of the body such that the automobile roof is in abutment with and supported by the rib projections 26 in the upright wall 16; and the rearview window portions and side walls of the automobile top 69 are respectively supported by the inclined wall 18 and side walls 40 and 42 of the body 12. Once the top 69 has been properly positioned within the body 12, the tabs 48 formed in the lower edge of the body 12 are slipped into the slots 70 in the lower edge of the cover 12 so as to properly align the cover with the body. The cover is pivoted about the tabs 48, to the position illustrated in FIG. 1, such that the flange 54 of the cover 14 is received within the recessed groove 52 of the body 12, thereby properly aligning the cover with the body 12. In this position the rib projections 68 will come into engagement with the outside surface of the rear window portion of the automobile top 69 to secure the automobile top within the body 12; that is, the automobile top bottom edge 73 (FIG. 8) and the automobile top side window edge 75 are respectively sandwiched between the rib projections 68 and the connecting wall 64. The engaging flanges 50 and 54, respectively, of the body 12 and cover 14 are provided with a plurality of strategically placed, aligned through bores 79 through which suitable fasteners, such as bolts 80, extend for threaded engagement with wing nuts 82 (FIG. 7). In this manner the cover is securely attached to the body 12. The container 10 is then raised to the upright position illustrated in FIG. 1 and 2 whereupon it may be simply moved about by means of the bearing wheels 34. In the usual situation the container 10 will be positioned against a wall in a garage and, preferably, with the rear side of the body 12 being against the garage wall such that the connecting wall 64 of the cover is exposed, as this wall 64 becomes a useful storage shelf during that period of time in which it is desired to store the automobile top 69.

It can thus be seen that applicant has provided a new and improved container for storing automobile tops in a manner which is safe and convenient and simple to manipulate by the user. It can also be seen that the same has been accomplished in an extremely inexpensive manner.

It should be understood by those skilled in the art of storage containers that other forms of applicant's invention may be had, all coming within the spirit of the invention and the scope of the appended claims.

What is claimed is as follows:

1. An automobile top storage container comprising:

a body having an upright wall contoured to receive and support the roof of an automobile top, said body having a lower inclined wall integral with said upright wall, said inclined wall being contoured to receive and support the rear window portion of said automobile top, said body having side walls extending laterally from the lower portion of said upright wall and integral with said upright wall and said inclined wall, said side walls being contoured to receive and support the sides of said automobile top;

a cover having a Z-shaped configuration and received by said body, said cover being contoured to support said automobile top and enclose said top in said body; and means for releasably securing said cover to said body.

2. The storage container defined in claim 1 wherein said inclined wall includes a pair of leg members disposed to support said storage container in an upright position; and wheel means mounted on the bottoms of said legs to permit said storage container to be manually moved.

3. The storage container defined in claim 1 wherein said body walls are provided with a plurality of ribs including rib projections at selected strategic locations along said ribs for providing support for said automobile top for preventing substantial portions of said automobile top from engaging said body walls.

4. The storage container defined in claim 1 wherein said cover has a pair of spaced slots disposed along one edge, said body having a pair of tabs adapted to be releasably engaged in said slot to permit said cover to be pivoted with respect to said body from an opened position to a closed position; and means for lockingly securing said cover to said body.

5. The storage container defined in claim 2 wherein said Z-shaped cover includes a pair of parallel walls connected by a lateral wall, said lateral wall being exposed when said cover is secured to said body, said exposed connecting wall defining a usuable shelf when said container is in said upright position.

6. The storage container defined in claim 1 wherein said body inclined wall, upright wall and side walls are of an integral, one-piece plastic construction and said cover is of an integral, one-piece construction.

* * * * *